US009222030B2

(12) United States Patent
Delude et al.

(10) Patent No.: US 9,222,030 B2
(45) Date of Patent: Dec. 29, 2015

(54) METHOD FOR REMOVING OXYGEN FROM AN OIL SAND STREAM

(71) Applicants: Shell Canada Energy, Calgary (CA); Chevron Canada Limited, Calgary (CA); Marathon Oil Canada Corporation L.P., Calgary (CA)

(72) Inventors: Stephen Gerard Delude, Calgary (CA); Steven Paul Giles, Damon, TX (US); Cristiane Michaëla Visser, Amsterdam (NL)

(73) Assignee: Shell Oil Company, Houston, TX (US)

( * ) Notice: Subject to any disclaimer, the term of this patent is extended or adjusted under 35 U.S.C. 154(b) by 344 days.

(21) Appl. No.: 13/890,902

(22) Filed: May 9, 2013

(65) Prior Publication Data

US 2013/0299392 A1 Nov. 14, 2013

(30) Foreign Application Priority Data

May 9, 2012 (CA) ..... 2776104

(51) Int. Cl.
*C10G 1/00* (2006.01)
*C10G 1/04* (2006.01)

(52) U.S. Cl.
CPC ..... *C10G 1/04* (2013.01)

(58) Field of Classification Search
CPC ..... C10G 1/00; C10G 1/04
See application file for complete search history.

(56) References Cited

U.S. PATENT DOCUMENTS 3,475,318 A 10/1969 Gable et al. ..... 208/11
2009/0301937 A1 12/2009 Duyvesteyn et al. ..... 208/390

FOREIGN PATENT DOCUMENTS

GB 208586 * 12/1928 ..... C10G 1/00

* cited by examiner

*Primary Examiner* — Renee E Robinson
*Assistant Examiner* — Derek Mueller

(57) ABSTRACT

The present invention provides a method for removing oxygen from an oil sand stream, the method including the steps of: (a) providing an oil sand stream; (b) introducing the oil sand stream into a liquid bath; (c) transporting the oil sand through the liquid bath to a confined space above the surface of the liquid bath; (d) removing the oil sand from the confined space; and (e) extracting bitumen from the oil sand removed in step (d).

19 Claims, 1 Drawing Sheet

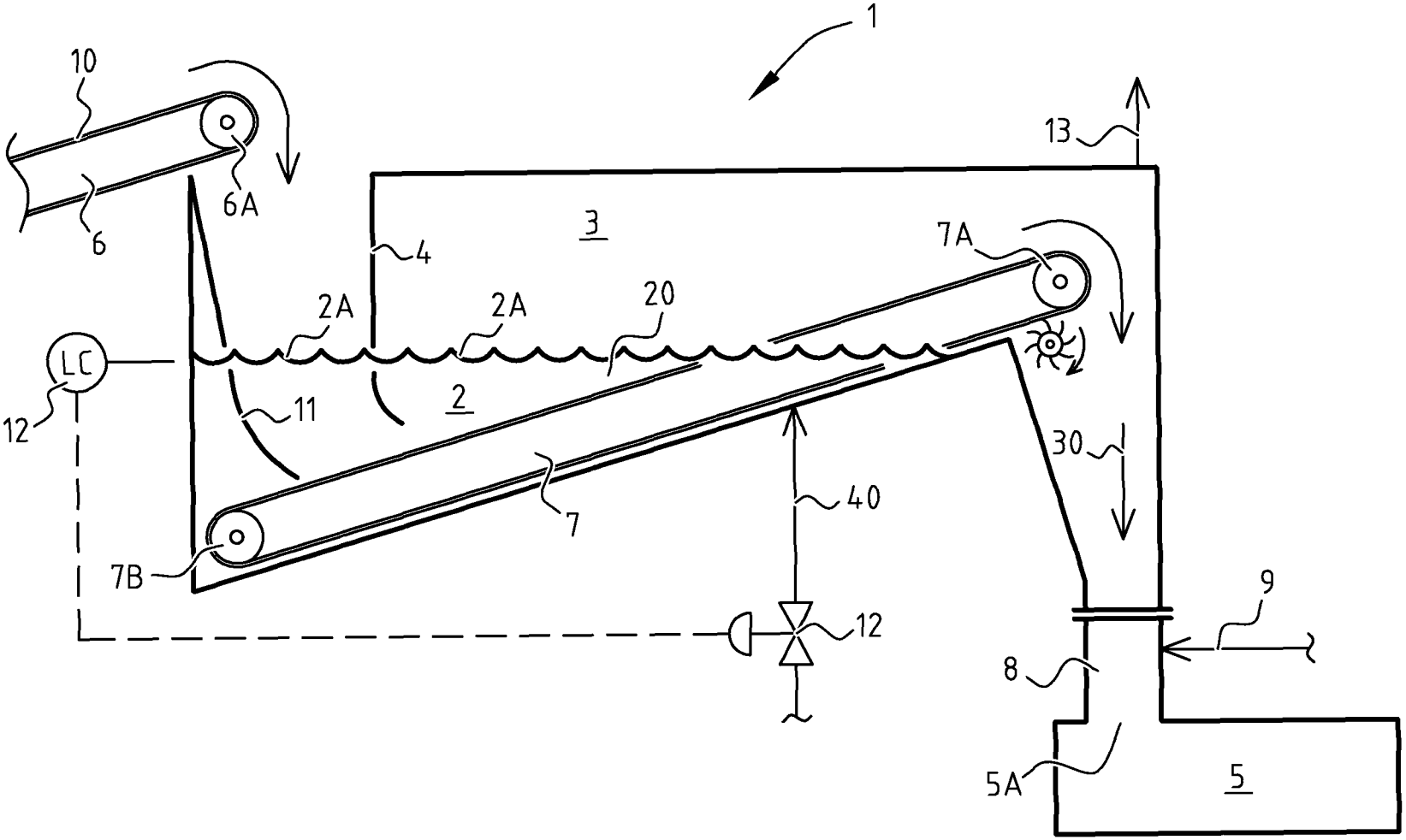
1
13
7A
30
9
5
8
5A
40
12
3
20
7
2A
2
4
2A
11
6A
10
6
LC
12
7B

METHOD FOR REMOVING OXYGEN FROM AN OIL SAND STREAM

This application claims the benefit of Canadian Application No. 2,776,104 filed May 9, 2012, which is incorporated herein by reference.

The present invention relates to a method for removing oxygen from an oil sand stream. In particular, the present invention relates to a method for removing oxygen from an oil sand stream, from which oil sand stream bitumen is to be extracted subsequently using a non-aqueous solvent.

Various methods have been proposed in the past for the recovery of bitumen (sometimes referred to as "tar" or "bituminous material") from oil sands as found in various locations throughout the world and in particular in Canada such as in the Athabasca district in Alberta and in the United States such as in the Utah oil sands. Typically, oil sand (also known as "bituminous sand" or "tar sand") comprises a mixture of bitumen (in this context also known as "crude bitumen", a semi-solid form of crude oil; also known as "extremely heavy crude oil"), sand, clay minerals and water. Usually, oil sand contains about 5 to 25 wt. % bitumen (as meant according to the present invention), 1 to 13 wt. % water, the remainder being sand and clay particles.

As an example, it has been proposed and practiced at commercial scale to recover the bitumen content from the oil sand by mixing the oil sand with water and separating the sand from the aqueous phase of the slurry formed. Disadvantages of such aqueous extraction processes are the need for extremely large quantities of process water (typically drawn from natural sources) and issues with removing the bitumen from the aqueous phase (whilst emulsions are being formed) and removing water from the bitumen-depleted sand.

Other methods have proposed non-aqueous extraction processes to reduce the need for large quantities of process water. Examples of such a non-aqueous extraction process are disclosed in e.g. U.S. Pat. No. 3,475,318 and US 2009/0301937, the teaching of which is hereby incorporated by reference.

A problem of known methods of non-aqueous solvent extraction of bitumen from oil sand is that the oxygen content of the oil sand needs to be reduced to a sufficient low level before the oil sand is contacted with the non-aqueous solvent for extracting the bitumen. This problem is in particular felt when a flammable organic solvent is used for extracting the bitumen.

It is an object of the present invention to solve or minimize this problem.

It is a further object of the present invention to provide an alternative method for removing oxygen from an oil sand stream, in particular when bitumen is to be extracted subsequently from the oil sand using a non-aqueous solvent.

One or more of the above or other objects may be achieved according to the present invention by providing a method for removing oxygen from an oil sand stream, the method comprising at least the steps of:

(a) providing an oil sand stream;
(b) introducing the oil sand stream into a liquid bath;
(c) transporting the oil sand through the liquid bath to a confined space above the surface of the liquid bath;
(d) removing the oil sand from the confined space; and
(e) optionally extracting bitumen from the oil sand removed in step (d).

It has now been found that the method according to the present invention provides a surprisingly simple and elegant manner to remove oxygen from the oil sand, resulting in significant savings in CAPEX and OPEX.

An important advantage of the present invention that it takes away the need for a large and continuous stream of an inert (e.g. nitrogen) or non-combustible gas flow, which would be required in a purge system, wherein the oxygen would be removed during passing through a solids feeder or the like whilst purging with the inert or non-combustible gas flow.

A further advantage according to the present invention is that the oxygen is removed more effectively, as significantly less oxygen is retained in any void spaces in the oil sand when being transported through the liquid bath, when compared to when a purge system would be used. Also, the liquid bath will function as a pressure seal against backflow of flammable vapours from downstream processing equipment. This obviously results in a significant safety improvement, as the risk of the creation of explosive conditions in the optional subsequent bitumen extracting step (where a flammable solvent may be used) is reduced.

According to the present invention, the providing of the oil sand stream in step (a) can be done in various ways. Usually, the oil sand ore is transported using one or more conveyor belts. Examples of a suitable conveyor are a belt/apron type conveyor, an enclosed Cambelt or Camwall conveyor, a submerged drag chain conveyor, an inclined screw conveyor, a mechanical ram/pusher conveyor, etc. Typically, oil sand is reduced in size, e.g. by crushing, breaking and/or grinding, to below a desired size upper limit. Preferably, the oil sand provided in step (a) has a particle size of less than 20 inch, preferably less than 16 inch, more preferably less than 12 inch.

In step (b), the oil sand is introduced in the liquid bath. To this end, the oil sand will typically fall from the end of a conveyor belt into the liquid bath, although other arrangements may be used as well. The liquid in the liquid bath is not limited in a specific way and can be selected from a wide range of liquids or combinations thereof. Non-limitative examples of the liquid are water, a hydrocarbon, dilbit (diluted bitumen), diesel, a heavy industrial solvent, etc., and combinations thereof. Preferably, the liquid in the liquid bath comprises a compound selected from the group consisting of water and a hydrocarbon having a flash point (preferably as determined according to ASTM E2079) that is above the operating temperature of the liquid bath, or a combination thereof. The hydrocarbon having a flash point that is above the operating temperature of the liquid bath may be any saturated or unsaturated aliphatic (i.e. non-aromatic) and aromatic hydrocarbon, and may include linear, branched or cyclic alkanes and alkenes and mixtures thereof. Typically, the hydrocarbon having a flash point that is above the operating temperature of the liquid bath is an aliphatic hydrocarbon having at least 10 carbon atoms per molecule.

Preferably, the liquid comprises at least 50 wt. %, more preferably at least 80 wt. % and even more preferably at least 90 wt. %, of water or said hydrocarbon having a flash point that is above the operating temperature of the liquid bath.

In step (c), the oil sand is transported through the liquid bath to a confined space above the surface of the liquid bath. Typically the transporting is done using one or more conveyor belts, although other transporters may be used instead or in addition. If desired, some kind of stirring or moving of the oil sand in the liquid may be performed in the liquid bath to promote that the oxygen is removed from the oil sand.

Preferably, in step (c) the oil sand underflows a weir during the transporting through the liquid bath.

Further it is preferred that in step (c) the oil sand is transported in an upwards direction. In this embodiment, the oil sand is introduced in the liquid bath and allowed to sink to a lower part of the liquid bath and subsequently transported upwards towards the confined space. Alternatively, the oil sand is transported in a substantially V-shaped or U-shaped direction.

The person skilled in the art will readily understand what is meant by a "confined space"; it is meant to indicate that substantially no additional oxygen can enter the confined space, after the removal thereof in the liquid bath (although a limited amount may still be entrained in the oil sand whilst being transported through the liquid bath). In one embodiment, the above-mentioned weir (under which the oil sand flows) may be one of the sides of the confined space.

Preferably, a purge gas is introduced into the confined space, preferably selected from the group consisting of nitrogen and flue gas, or a combination thereof. Further it is preferred that the oxygen concentration in the confined space is below a level that creates an explosive or flammable confined space (e.g. as determined by ASTM E2079). Typically there is at least a slight overpressure in the confined space; preferably the pressure in the confined space is from 0.001 to 0.35 barg. Further it is preferred that the temperature in the confined space is around ambient temperature, typically from −20 to 30° C., preferably above 0° C., more preferably above 10° C. and preferably below 25° C.

In step (d) the oil sand is removed from the confined space. Typically, the oil sand is transported using a conveyor belt out of the liquid bath and through the confined space and then simply drops into a feeder to downstream processing (including bitumen extraction). Preferably, the oil sand is drained first to remove superfluous liquid as entrained whilst transporting through the liquid bath before being subjected to such downstream processing.

Preferably and typically, bitumen is extracted from the oil sand in step (e). The person skilled in the art will readily understand how to do this; hence, this is not further discussed here in detail. To this end, the bitumen may be extracted using for example an aromatic or aliphatic hydrocarbon solvent (or a combination thereof). Preferably, in step (e) the bitumen is extracted from the oil sand, using an aliphatic or aromatic hydrocarbon solvent, preferably an aliphatic hydrocarbon solvent. In this case, it is preferred that the oxygen concentration in the confined space is below the flammability level (as determined by ASTM E2079) of the aliphatic or aromatic hydrocarbon solvent as used in the extracting of the bitumen from the oil sand.

As indicated above, the solvent for extracting the bitumen from the oil sand in step (e) is preferably an aliphatic (i.e. non-aromatic) solvent, and may be any saturated or unsaturated aliphatic solvent and may include linear, branched or cyclic alkanes and alkenes and mixtures thereof. Preferably, the solvent as used for the bitumen extraction in step (e) comprises an aliphatic hydrocarbon having from 3 to 9 carbon atoms per molecule, more preferably from 4 to 7 carbons per molecule, or a combination thereof. Especially suitable solvents are saturated aliphatic hydrocarbons such as propane, butane, pentane, hexane, heptane, octane and nonane, in particular butane, pentane, hexane and heptanes (and isomers thereof). It is preferred that the solvent in step (e) comprises at least 90 wt. % of the aliphatic hydrocarbon having from 3 to 9 carbon atoms per molecule, preferably at least 95 wt. %. Also, it is preferred that in step (e) substantially no aromatic solvent (such as toluene or benzene) is present, i.e. less than 5 wt. %, preferably less than 1 wt. %.

Hereinafter the invention will be further illustrated by the following non-limiting drawing. Herein shows:

FIG. 1 schematically a process scheme of a non-limiting embodiment of a method in accordance with the present invention.

For the purpose of this description, a single reference number will be assigned to a line as well as a stream carried in that line.

FIG. 1 schematically shows a simplified process scheme according to the present invention for removing oxygen from an oil sand feed stream, from which subsequently bitumen is to be extracted. The process scheme is generally referred to with reference numeral 1. The process scheme 1 shows a water bath 2, a confined space 3, a weir 4, a mixer 5, and two conveyor belts 6 and 7.

During use of the process scheme of FIG. 1, an oil sand feed stream 10 is provided via conveyor belt 6 and introduced into the liquid bath 2. Typically, the oil sand 10 has been crushed or treated otherwise, to reduce the size of the larger oil sand lumps to below a pre-determined upper limit, such as below 14 inch.

In the embodiment of FIG. 1, the oil sand simply falls from the end 6A of the conveyor belt 6 (via guide plate 11) into the liquid bath 2 and sinks to the bottom thereof, onto the conveyor belt 7. Then, the oil sand is transported as stream 20 by the conveyor belt 7 towards the confined space 3 located above the surface 2A of the liquid bath 2. In the embodiment of FIG. 1 the oil sand 20 is transported in an upwards direction to the confined space 3, i.e. from the lower end 7B to the upper end 7A of the conveyor belt 7, whilst underflowing the weir 4.

Subsequently, the oil sand is removed from the confined space 3 and sent to a further processing step, in particular bitumen extraction. To this end, in the embodiment of FIG. 1, the oil sand drops off the upper end 7A as stream 30 and falls into a chute 8 connected to the inlet 5A of the mixer 5. If desired, the oil sand may be dried before entering the inlet 5A of the mixer 5. In the mixer 5, the oil sand may be mixed with a solvent (in particular an aliphatic hydrocarbon solvent) to extract the bitumen from the oil sand.

Further shown in FIG. 1 is a level control 12 to control the liquid level in the liquid bath 2; if needed make-up liquid 40 may be added to the liquid bath 2. Also, FIG. 1 shows an inlet 9 for introducing a purge gas (such as nitrogen or flue gas) into the confined space 3 and a gas outlet 13, connected to an $O_2$-sensor (not shown) to measure the oxygen concentration in the confined space 3.

The person skilled in the art will readily understand that many modifications may be made without departing from the scope of the invention.

What is claimed is:

1. A method for removing oxygen from an oil sand stream, the method comprising at least the steps of:

(a) providing an oil sand stream;

(b) introducing the oil sand stream into a liquid bath;

(c) transporting the oil sand through the liquid bath to a confined space above the surface of the liquid bath wherein a temperature in the confined space is between −20° C. and 30° C.; and (d) removing the oil sand from the confined space.

2. The method of claim 1 further comprising the step of extracting bitumen from the oil sand removed in step (d).

3. The method of claim 1, wherein the oil sand provided in step (a) has a particle size of less than 20 inches.

4. The method of claim 3, wherein the oil sand provided in step (a) has a particle size of less than 12 inches.

5. The method of claim 1, wherein the liquid in the liquid bath comprises a compound selected from the group consisting of water and a hydrocarbon having a flash point that is above the operating temperature of the liquid bath, and a combination thereof.

6. The method of claim 1, wherein in step (c) the oil sand underflows a weir during the transporting through the liquid bath.

7. The method of claim 1, wherein in step (c) the oil sand is transported in an upwards direction.

8. The method of claim 1, wherein a purge gas is introduced into the confined space.

9. The method of claim 8, wherein the purge gas is selected from the group consisting of nitrogen and flue gas, and a combination thereof.

10. The method of claim 1, wherein an oxygen concentration in the confined space is below a level that creates an explosive or flammable confined space.

11. The method of claim 1, wherein a pressure in the confined space is between about 0.001 and about 0.35 barg.

12. A method for removing oxygen from an oil sand stream, the method comprising at least the steps of:

(a) providing an oil sand stream;
(b) introducing the oil sand stream into a liquid bath;
(c) transporting the oil sand through the liquid bath to a confined space above the surface of the liquid bath;
(d) removing the oil sand from the confined space; and
(e) extracting bitumen from the oil sand removed in step (d) using an aromatic solvent.

13. The method of claim 12, wherein a purge gas is introduced into the confined space.

14. The method of claim 13, wherein the purge gas is selected from the group consisting of nitrogen and flue gas, and a combination thereof.

15. The method of claim 12, wherein an oxygen concentration in the confined space is below the flammability level (as determined by ASTM E2079) of the aromatic hydrocarbon solvent.

16. A method for removing oxygen from an oil sand stream, the method comprising at least the steps of:

(a) providing an oil sand stream;
(b) introducing the oil sand stream into a liquid bath;
(c) transporting the oil sand through the liquid bath to a confined space above the surface of the liquid bath;
(d) removing the oil sand from the confined space; and
(e) extracting bitumen from the oil sand removed in step (d) using an aliphatic solvent.

17. The method of claim 16, wherein a purge gas is introduced into the confined space.

18. The method of claim 17, wherein the purge gas is selected from the group consisting of nitrogen and flue gas, and a combination thereof.

19. The method of claim 16, wherein the oxygen concentration in the confined space is below the flammability level (as determined by ASTM E2079) of the aliphatic hydrocarbon solvent.

* * * * *